United States Patent [19]

Armiger et al.

[11] Patent Number: 5,047,996

[45] Date of Patent: Sep. 10, 1991

[54] SONAR TRANSDUCER

[75] Inventors: Ronald E. Armiger, Millersville; Joyce M. Mang, Arnold, both of Md.

[73] Assignee: Westinghouse Electric Corp., Pittsburgh, Pa.

[21] Appl. No.: 440,139

[22] Filed: Nov. 22, 1989

[51] Int. Cl.[5] ..... H04R 1/02

[52] U.S. Cl. ..... 367/154; 367/171; 367/173

[58] Field of Search ..... 181/110-112, 181/122; 367/129, 153-156, 173, 178, 188

[56] References Cited

U.S. PATENT DOCUMENTS 3,480,906 11/1969 Thompson ..... 367/166 X 4,745,584 5/1988 Anderson ..... 367/153

4,864,179 9/1989 Lapetina et al. ..... 367/155 X

*Primary Examiner*—Brian S. Steinberger

*Attorney, Agent, or Firm*—D. Schron

[57] ABSTRACT

A sonar transducer wherein a plurality of transducer modules are affixed along the length of a mounting member in the form of an elongated bar. The bar is contained within a protective housing and the mid point of the mounting member is affixed to the back wall of the housing in a manner that the mounting member stands off from the back wall of the housing. The mounting member is cantilevered on either side of the mounting position and is totally enclosed within the outer housing which is affixed along its entire length to a host structure so as to isolate and protect the alignment of the transducer modules from distortions.

8 Claims, 5 Drawing Sheets

SONAR TRANSDUCER

BACKGROUND OF THE INVENTION

1. Field of the Invention

The invention in general relates to underwater acoustic transducers, and more particularly, to a sonar transducer useful for forming narrow beams.

2. Background Information

Sonar transducers generally include one or more active transducer elements for the projection and/or reception of acoustic energy. In order to form an extremely narrow beam, such as may be utilized in the side looking sonar field, the transducer is elongated and contains a plurality of active elements arranged in a line array. In general, the longer the array the higher will be the resolution obtainable. However, there is a limit on the length of the transducer since the housing which carries the active elements becomes prohibitively massive for practical use. With the present invention, present day limits on length can be greatly increased so as to provide for much higher resolution systems.

SUMMARY OF THE INVENTION

A transducer in accordance with the present invention includes an elongated mounting member with a plurality of transducer modules being affixed to the mounting member along its length. The transducer modules include at least a transducer active element for projection and/or reception of acoustic energy and in one embodiment, transducer modules are positioned on one side of the elongated mounting member and a plurality of like electronic modules are positioned on the other side thereof.

A housing is provided, and the mid portion of the mounting member is connected to the housing such that it stands off from the back wall of the housing and is cantilevered on both sides of the mid portion. An acoustic window on the front of the housing keeps out the surrounding water medium, and keeps in a protective oil normally contained within the housing. With the mounting member within the housing, the housing is then mounted along its length to a host structure.

DESCRIPTION OF THE PREFERRED EMBODIMENT

Figure 1:
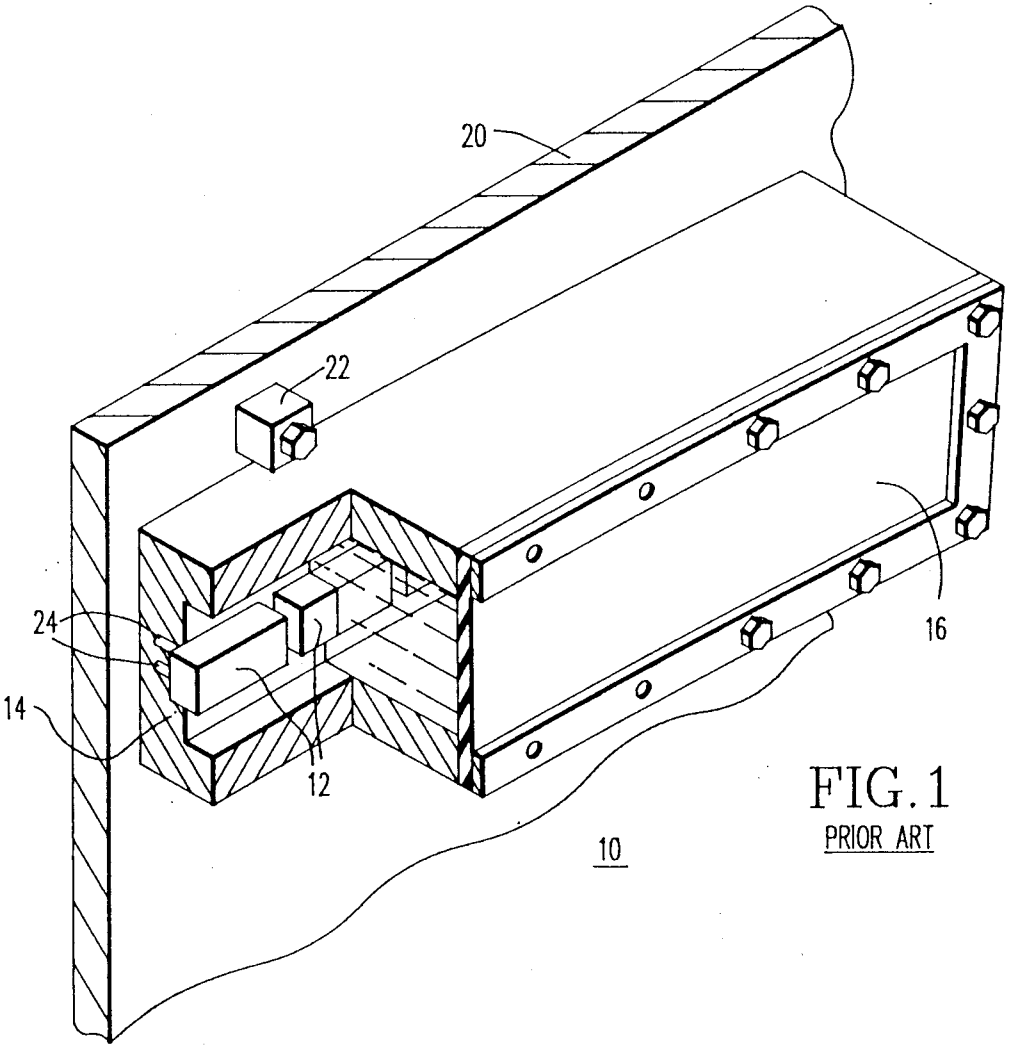
FIG. 1 PRIOR ART
FIG. 1 is an isometric view with portions broken away of a typical prior art transducer of the class described.
Figure 2:
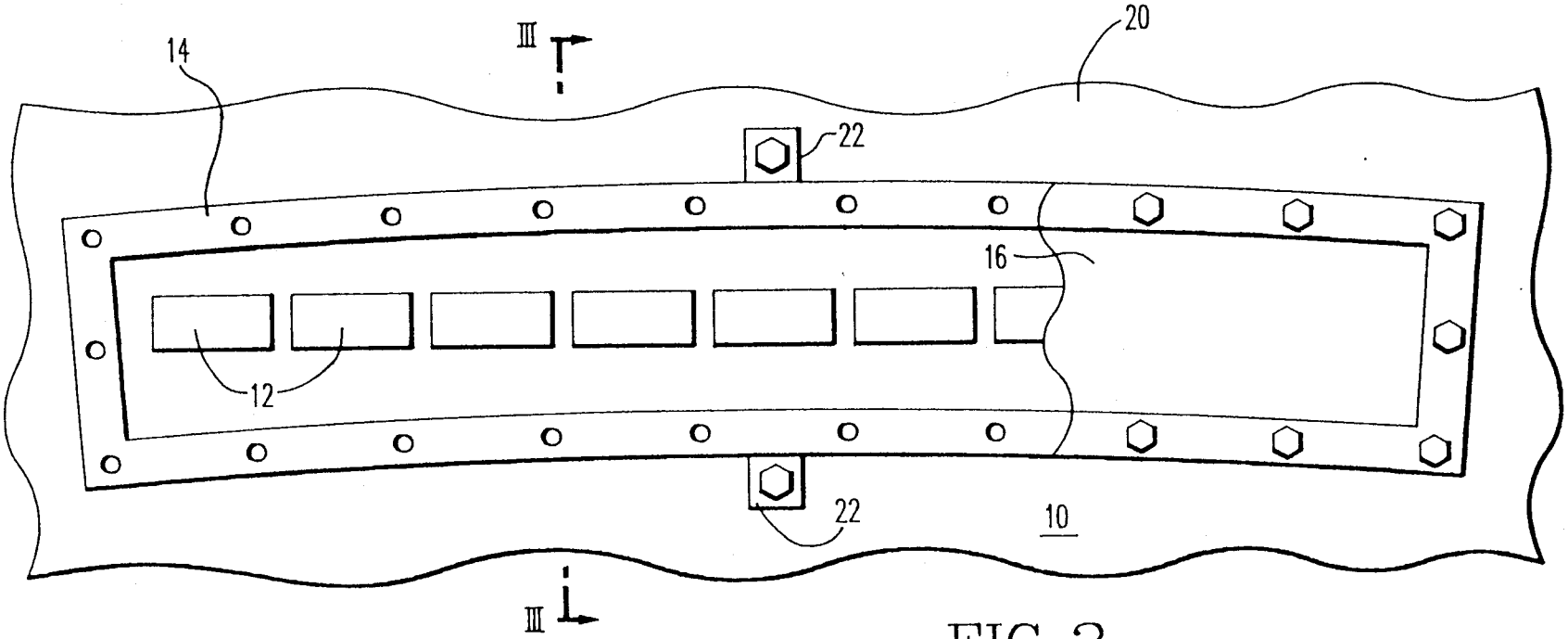
FIG. 2 PRIOR ART
FIG. 2 is a front view of the transducer of the prior art with a portion of the acoustic window stripped away of the transducer of the prior art.
Figure 3:
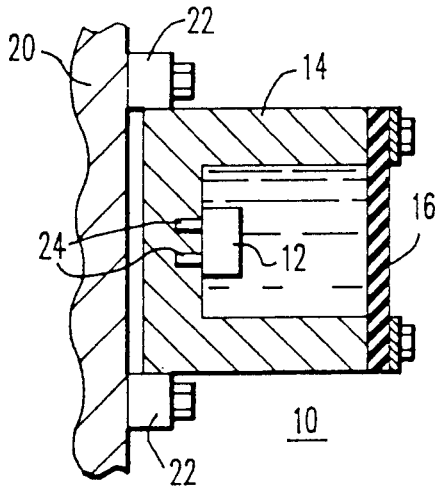
FIG. 3 PRIOR ART
FIG. 3 is a view along line III—III of FIG. 2.

Referring now to FIGS. 1, 2 and 3, there is illustrated a transducer for forming, in conjunction with associated electronic equipment, one or more narrow beams which may be utilized in the side looking sonar field. Transducer 10 includes a plurality of transducer modules 12 mounted in a heavy C-channel housing 14. The front of the housing is sealed by an acoustic window 16 and the interior of the housing is filled with a transducer compatible oil required for acoustic coupling, electrical insulation and corrosion prevention.

The mid portion of housing 14 is connected to a host structure 20 by means of mounting brackets 22 such that the heavy C-channel is cantilevered on both sides of the mounting, thus isolating the transducer from any host structure distortions.

The individual transducer modules are mounted with the assistance of guide pins 24 and if a straight line array is desired during operation, the guide pin holes, during manufacturing, lie about a line which is slightly concave upwards so that when mounted to a host structure, taking into consideration the weight of the housing 14, modules 12, as well as any related electronic equipment (not shown) the transducer modules will be arranged in a horizontal straight line array.

Any deviation of a transducer module from the ideal position, may be accommodated by small adjustments in the electronics. After manufacture and adjustment however, any small deviation of the transducer elements from their final position will degrade the performance of the transducer. Such deviation may be caused by distortion due to undesired movement of the housing, hydrodynamic forces, or handling. The C-channel housing 14 therefore is made very massive to resist any hydrodynamic deflections and handling damage. With this prior art design however, as the length of the transducer increases for increased resolution, the mass of the C-channel housing becomes prohibitively large. Further, the housing must be made of a strong non-corroding material which significantly increases the cost of the transducer.

Figure 6:
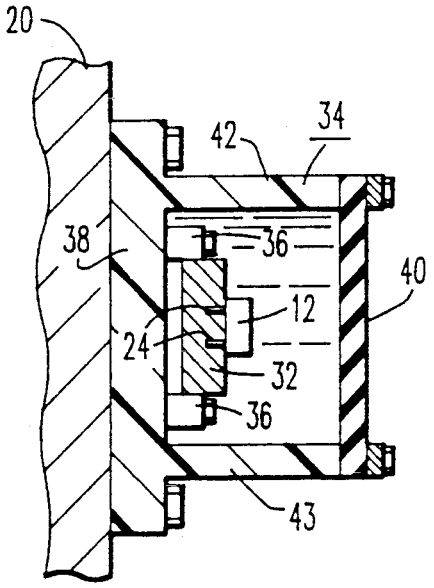
FIG. 6 is a view along line VI—VI of FIG. 5.
Figure 4:
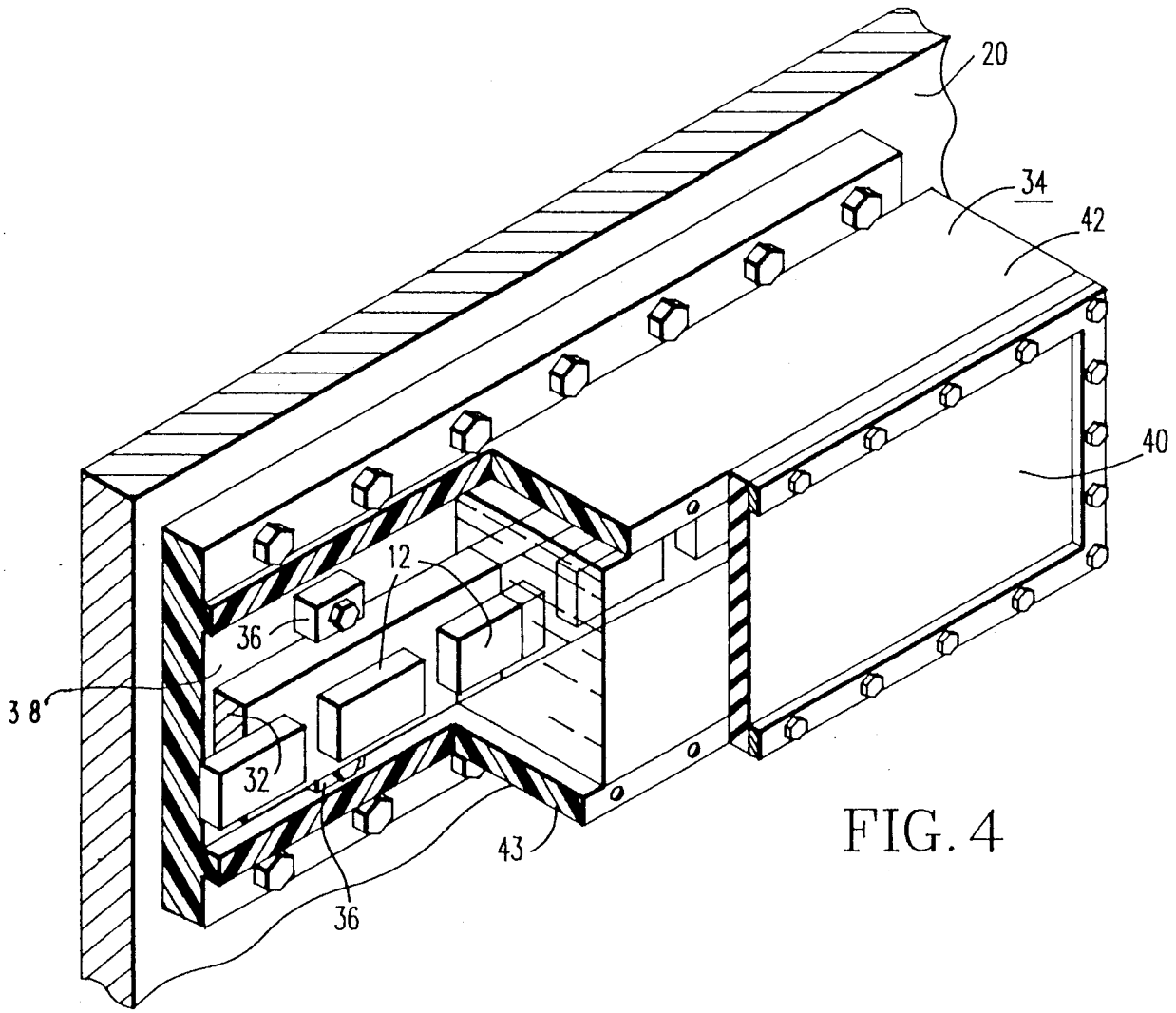
FIG. 4 is an isometric view, with portions broken away, of one embodiment of the present invention.
Figure 5:
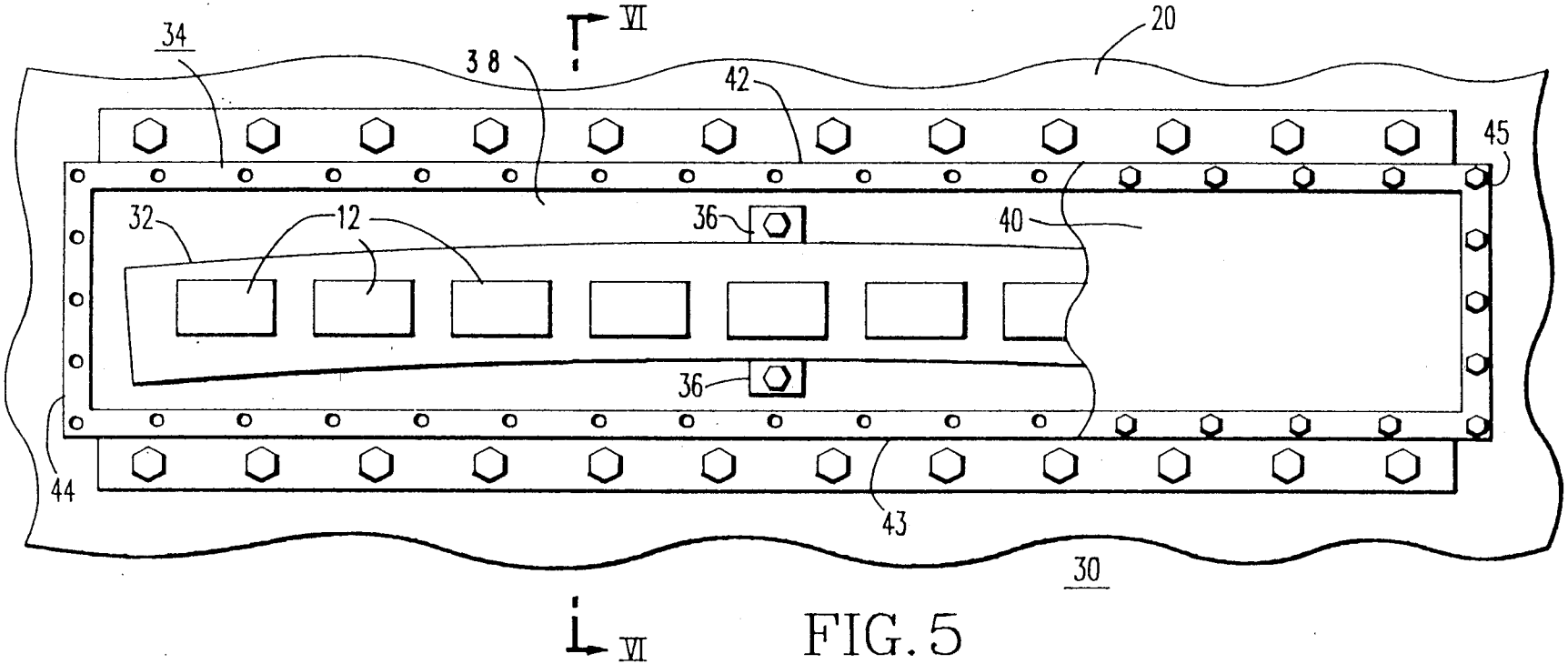
FIG. 5 is a front view of the transducer.

The transducer of the present invention allows for much longer arrays to be built without the disadvantages attendant with the prior art structure, and to this end, reference is made to FIGS. 4, 5 and 6 illustrating one embodiment of the present invention. Improved transducer 30 includes an elongated mounting member 32 with a plurality of transducer modules 12 being affixed thereto along its length and maintained in accurate alignment by means of guide pins 24. The elongated mounting member is contained within a housing 34 and mounted therein by means of brackets 36 secured by way of example to the back wall 38 of the housing 34 in a manner that the mounting member 32 stands off from the back wall 38, as best seen in FIG. 6, and is cantilevered on both sides of the mid portion attachment, as best illustrated in FIG. 5. During fabrication, the transducer modules 12 are affixed to mounting member 32 in a slightly concave arrangement so that they may assume the straight line arrangement illustrated, during operation.

An acoustic window 40 is attached to the top, bottom, and side walls 42 to 45 of the housing in order to exclude the water medium and to maintain a transducer compatible fluid within the internal cavity formed by the housing 34. The housing 34 may be made of relatively light weight and flexible material such as aluminum bronze, or as illustrated, a plastic, and is secured along the length thereof, to the host structure 20. With the housing being mounted to the host structure continuously along its length, the housing is allowed to deform with the host structure without disturbing the mounting member 32, as long as adequate clearance is provided between it and the housing 34. Further, the housing protects the mounting member from any external forces such as hydrodynamic loads, or those which may be encountered during handling.

In comparison with the prior art structure, the transducer modules in the present invention are affixed to a relatively light weight mounting member instead of a relatively massive housing. The mounting member may be made of light weight material such as aluminum or magnesium and may therefore be extended to greater lengths for greater resolution unattainable with the prior art construction, and with the mounting member 32 being fully protected within the housing 34.

Figure 7:
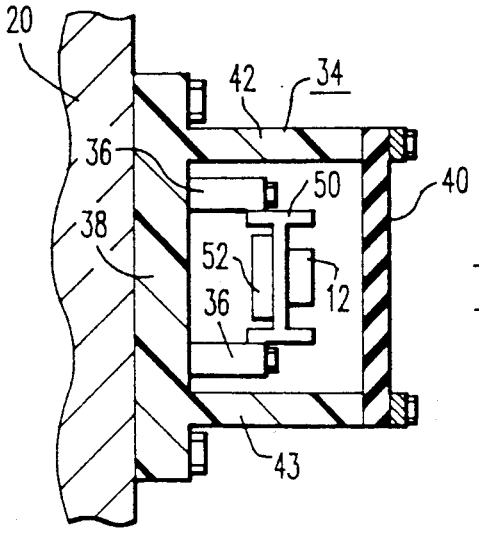
FIG. 7 is a cross-sectional side view of an alternate embodiment.

In the embodiment of the invention illustrated in FIGS. 4 to 6, the elongated mounting member 32 is rectangular in cross-section with a transducer module 12 being mounted on one side thereof. In an alternate arrangement and as illustrated in FIG. 7, an elongated mounting means 50 has affixed to one side thereof transducer modules 12 and on an opposite side thereof electronic modules 52. The mounting member may be rectangular in cross-section or as a variation, and as illustrated in FIG. 7 may be an I-beam, mounted at its mid portion to the backwall 38 of the housing 34.

What is claimed is:

1. An underwater transducer comprising:

a) an elongated mounting member;

b) a plurality of transducer modules, each including at least a transducer active element for acoustic energy transfer with the water environment;

c) said modules being affixed to said mounting member along the length thereof;

d) a housing including a back wall;

e) means for connecting the mid portion of said mounting member to said housing such that said mounting member stands off from said back wall and is cantilevered on both sides of said mid portion;

f) means for excluding the surrounding water medium from gaining entry to the interior of said housing; and g) means for mounting said housing to a host structure.

2. Apparatus according to claim 1 wherein:

a) when said mounting member is in its cantilevered orientation said modules are arranged along a straight line.

3. Apparatus according to claim 1 wherein:

a) said mid portion of said mounting member is connected to said back wall of said housing.

4. Apparatus according to claim 1 wherein:

a) said housing is relatively lightweight and flexible so as to conform to said host structure and is able to accommodate twisting and bending thereof.

5. Apparatus according to claim 1 wherein:

a) said mounting member is an elongated bar and rectangular in cross section.

6. Apparatus according to claim 1 which includes:

a) a plurality of electronic modules;

b) said transducer modules being affixed to one side of said mounting member;

c) said electronic modules being affixed to an opposite side of said mounting member.

7. Apparatus according to claim 1 wherein:

a) said housing includes a top wall, bottom wall and side walls defining an internal cavity;

b) said means for excluding the water medium includes an acoustic window covering said cavity and connected to said top, bottom and side walls of said housing.

8. Apparatus according to claim 7 which includes:

a) a transducer-compatible oil filling said cavity.

* * * * *